US008078082B2

(12) United States Patent
Mandel et al.

(10) Patent No.: US 8,078,082 B2
(45) Date of Patent: Dec. 13, 2011

(54) MODULAR PRINTING SYSTEM

(75) Inventors: Barry Paul Mandel, Fairport, NY (US); James J. Spence, Honeoye Falls, NY (US); Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 414 days.

(21) Appl. No.: 12/331,768

(22) Filed: Dec. 10, 2008

(65) Prior Publication Data

US 2010/0142990 A1 Jun. 10, 2010

(51) Int. Cl.
*G03G 15/00* (2006.01)

(52) U.S. Cl. ..... 399/110; 399/401; 399/407

(58) Field of Classification Search ..... 399/107, 399/110, 122, 401, 407
See application file for complete search history.

(56) References Cited

U.S. PATENT DOCUMENTS

| | | | | |
|---|---|---|---|---|
| 4,873,554 | A | 10/1989 | Greco, Jr. | |
| 4,972,236 | A | 11/1990 | Hasegawa | |
| 5,144,369 | A | 9/1992 | Benedict et al. | |
| 5,850,581 | A | 12/1998 | Roller | |
| 6,308,026 | B1 | 10/2001 | Kouchi | |
| 6,626,110 | B1 | 9/2003 | Keller | |
| 6,973,286 | B2 | 12/2005 | Mandel et al. | |
| 7,024,152 | B2 | 4/2006 | Lofthus et al. | |
| 7,024,521 | B2 | 4/2006 | Glasco | |
| 7,031,636 | B2 * | 4/2006 | Schultheis et al. | 399/107 |
| 7,093,831 | B2 | 8/2006 | Biegelsen et al. | |
| 7,123,873 | B2 | 10/2006 | deJong et al. | |
| 7,206,536 | B2 * | 4/2007 | Julien | 399/110 |
| 2006/0067757 | A1 | 3/2006 | Anderson et al. | |
| 2006/0176336 | A1 | 8/2006 | Moore et al. | |
| 2007/0081064 | A1 * | 4/2007 | Spencer et al. | 347/104 |
| 2007/0127945 | A1 | 6/2007 | Parisi et al. | |
| 2007/0127957 | A1 * | 6/2007 | Spence et al. | 399/320 |

FOREIGN PATENT DOCUMENTS

EP 1 630 624 A3 8/2006

OTHER PUBLICATIONS

Frank De Jong, European Search Report for EP 09 17 7325, Completed Apr. 9, 2010, 10 pages, The Hague.

* cited by examiner

*Primary Examiner* — David M Gray
*Assistant Examiner* — Joseph Wong
(74) *Attorney, Agent, or Firm* — Fay Sharpe LLP

(57) ABSTRACT

A method and apparatus for a modular printing system having individual units comprising input modules, transporter modules, marking engine modules, fuser modules and exit modules each with its own support structure and cabinet. The modular units have common matching interface configurations for paper feed and electrical connections so as to permit numerous combinations and variations of printing systems capable of monochrome, color, duplex, hybrid and simplex printing by modular interconnection as opposed to built-up systems.

20 Claims, 21 Drawing Sheets

MODULAR PRINTING SYSTEM

BACKGROUND

The present disclosure relates to digital printing systems where flexibility is desired for printing both monochromatic and color prints on sheet stock and where it is desired to employ more than one print engine operating on a given print job and to provide the flexibility of simplex or duplex printing. Systems of this type require flexibility in varying the path of the sheet stock to enable the use of plural print engines either in tandem or in parallel and to provide duplex printing. Thus, various combinations of inverters and transporters are required to feed sheet stock through the unit to accomplish the desired printing function. Heretofore, in order to provide the desired printing flexibility, the machine or system was built up of the various components such as inverters, transporters, marking engines, fusers and finishers in order to provide a particular desired combination of printing capability; and, the components were built up or assembled on a frame and housed in a cabinet to provide the completed machine. As the desired flexibility and combinations of printing capability were increased, the number of components assembled onto the frame disposed within the cabinet increased. The complexity of interconnecting the various components and the controls for a desired machine configuration has resulted in relatively expensive equipment which has limited the marketability of the systems relative to the desired capabilities.

Thus, it has been desired to find a way to provide the desired complex printing functions for which modern digital printers are capable and to provide such multi-function capacity in a machine that was relatively low in manufacturing cost yet reliable and robust in service.

BRIEF DESCRIPTION

The present disclosure describes a photo copying/digital printing system having the capability of monochrome, color, duplex, hybrid and simplex printing and employs modular units comprising transporters, inverters, marking engines and fusers which have common or interchangeable interfaces and which modules are structurally self contained each with its own supporting frame and housing or cabinet. The modules may be constructed to have common electrical and sheet transporting/feeding interfaces such that the modules may be readily interconnected in the desired manner to provide the printing capabilities or functions required. The modular construction of the printing system thus enables common components to be employed in various arrangements of the printing system without incurring the cost of an individual built up machine with customized supporting structure or cabinetry for each desired system. Because the basic elements can be used to create a variety of printer configurations, the overall build volume of each element is relatively high resulting in cost savings for each configuration due to economies of scale and reuse.

BRIEF DESCRIPTION OF THE DRAWINGS

In FIG. 17, item 25 should be a slot (as shown in FIG. 18)]

FIG. 18*a* is an enlarged view of a left hand portion of the interface of the module of FIG. 17 along with the mating interface for the module it would dock to;

DETAILED DESCRIPTION

Figure 1A:
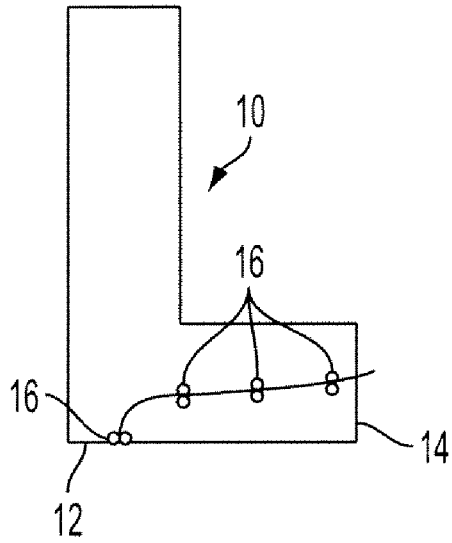
FIG. 1*a* is a schematic of an input/registration module for the upper one of vertically stacked marking engines.

Referring to FIG. 1*a*, a modular upper input/registration unit is shown schematically as having an L-shaped configuration indicated generally at 10 and has a lower or left side interface 12, and a right side interface 14 for receiving a sheet stock from a transporter or lower input/registration unit (See FIG. 5) and for discharge to a marking engine. As will be hereinafter discussed in greater detail, the interfaces 12, 14 have a common configuration for sheet stock movement and for electrical connection thereto. The unit 10 of FIG. 1 has a plurality of spaced nips 16 provided therein for moving sheet stock along a path therethrough and for registering or aligning the sheets prior to delivering the media to a marking engine located downstream. It will be understood that the terms left side interface and right side interface refer generally to the media transport interfaces near each end of the modules and are not limited to interfaces located on vertical left or right facing surfaces of the modules.

Figure 1B:
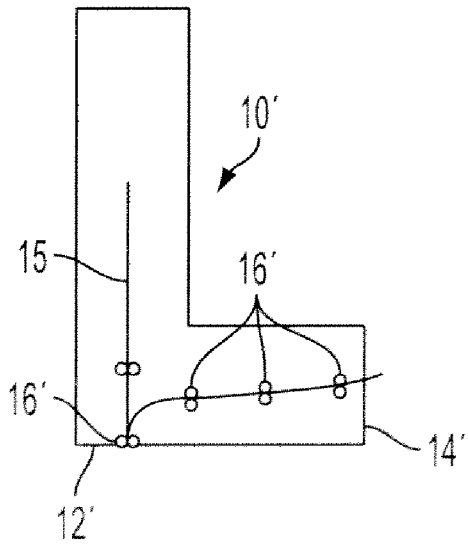
FIG. 1*b* is a schematic of an alternate version of the module of FIG. 1*a* including an inverter.

Referring to FIG. 1*b*, an alternate version of L-shaped module 10 is indicated generally at 10' with lower or left side interface 12' and right side interface 14' for receiving sheet stock from an adjacent transporter or lower input/registration unit and for discharge to a marking engine. Interfaces 12', 14' have a common configuration for sheet stock movement and electrical connection. Module 10' also has a plurality of nips 16' for moving sheet stock along a path therethrough; and, module 10 includes an inverter 15.

Figure 2:
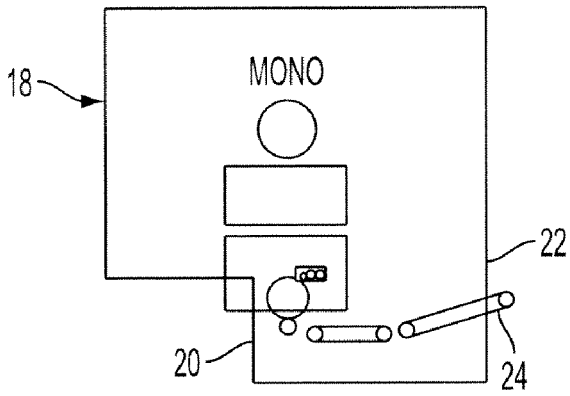
FIG. 2 is a schematic of a modular monochrome marking engine for a vertically stacked arrangement.

Referring to FIG. 2, a monochromatic integrated marking engine is indicated generally at 18 and has a modular configuration with a left side interface 20 and a right side interface 22 with the left side interface 20 provided in an L shaped cutout; and, interface 22 is adapted to interconnect to the right side interface 14 of the module of FIG. 1 or to any other module with a common interface. The interfaces 20, 22 of the module 18 form part of a cabinet or housing for the module 18. The left side interface 20 and the right side interface 22 have common features for enabling cross-boundary sheet stock movement and to provide for electrical connection thereto with the interfaces 12, 14 of FIG. 1. The monochromatic marking engine 18 of FIG. 2 discharges paper at interface 22 through a transport belt indicated by reference numeral 24.

Figure 3:
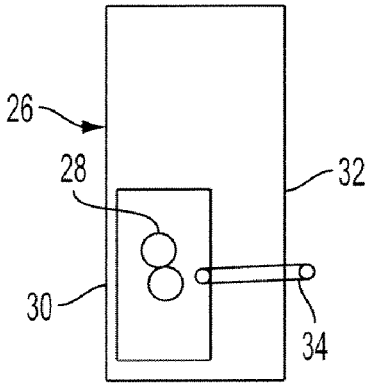
FIG. 3 is a schematic of a monochrome fuser employed with electrostatic photocopier/printers.

Referring to FIG. 3, a modular fuser is indicated generally at 26 with its own supporting structure in a cabinet shown in solid outline and has nips 28 provided therein; and, fuser 26 receives sheet stock from the right side interface 24 of marking engine 18 of FIG. 2 at a left side interface 30 thereof. The fuser 26 receives sheet stock from the nip 28 and discharges the sheet stock through a right side interface 32 on a transporter belt 34. The right side interface 32 and left side interface 30 may have receiving and discharge slots for sheet stock and electrical connections for mating with the marking engine such as marking engine 18.

Figure 4:
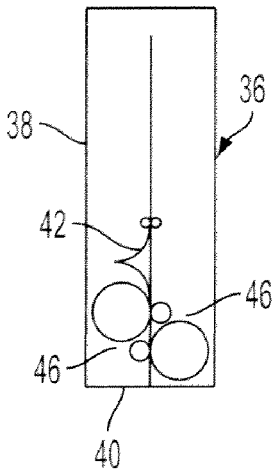
FIG. 4 is a schematic of a modular upper exit/inverter component for use in systems employing vertically stacked marking engines.

Referring to FIG. 4, a modular upper exit/inverter unit is illustrated and indicated generally at 36 and includes a left side interface 38 and a right side interface 40 for sheet stock with an inverter 42 disposed therein in its own cabinet or housing shown in solid outline with a pair of nips 44, 46 for providing optional decurling of media and providing flow of sheet stock therethrough. The interface 38 has a matching configuration for sheet stock feed and electrical connection with the right side interface 32 of the fuser 26 of FIG. 3 or any other module with a matching right side interface.

Figure 5A:
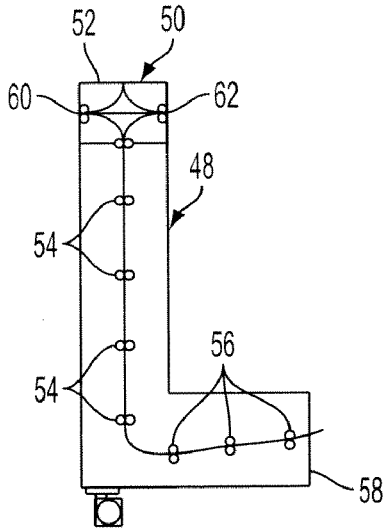
FIG. 5*a* is a schematic of a lower input/registration module for use in vertically stacked marking engine system.

Referring to FIG. 5*a*, a modular lower input/registration unit is illustrated generally at 48 with its own internal supporting structure (not shown) and housed in its own cabinet shown in solid outline. The module 48 has a generally L shaped configuration with a junction transport indicated generally at 50 provided at the upper end thereof which has a left side interface 60 provided thereon Module 48 has a plurality of sheet moving nips 54 provided therein for transporting the sheet stock downwardly as noted by reference numeral 54. A plurality of secondary nips 56 are provided and are operative to register or align the sheet stock and move it to the right side interface 58 which mates with the left side interface 77, 20 of the marking modules shown in FIGS. 7 and 2 respectively.

The transport 50 also has a top side interface 52 and a right side interface 62, which may be common with the interfaces 60, 58.

Figure 5B:
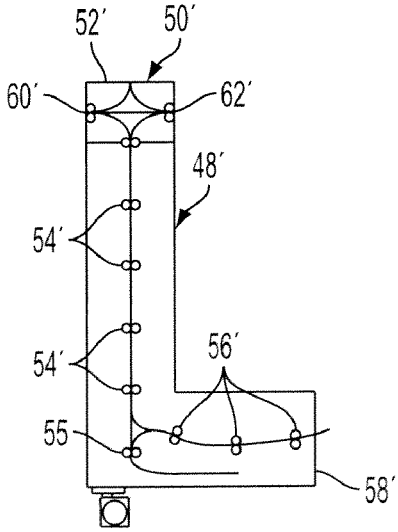
FIG. 5*b* is a schematic of an alternate version of the module of FIG. 5*a* including an inverter.

Referring to FIG. 5*b*, an alternate version of an L-shaped lower input/registration module 48 is illustrated and indicated generally at 48' and has a junction transport indicated generally at 50' at the upper end thereof which has a left side interface 60'. Module 48' also has a plurality of nips 54' for moving sheet stock downwardly therethrough. An inverter is provided and indicated generally at 55 and a plurality of secondary nips 56' register and align the sheet stock and move it to the right side interface 58'. Transport 50' also has a top side interface 52' and a right side interface 62' which may be common with interface 60'.

Figure 6:
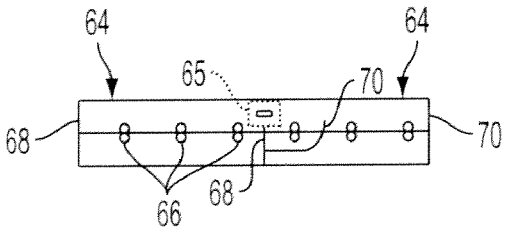
FIG. 6 is a schematic view of a dual arrangement of a bidirectional transporter for sheet stock.

Referring to FIG. 6, a dual module transporter is shown in solid outline in its own housing or cabinet and comprises two single modules each indicated generally at 64 and includes a plurality of nips 66 for transporting sheet stock from a right side interface 70 to a left side interface 68 which is shown connected to a similar interface for a second similar transporter 64 which is connected in tandem with the unit 64 for single path sheet stock passage therethrough. Transports 64 can be bi-directional allowing sheet stock to travel in both Left to Right and Right to Left directions. The left side interface 68 for sheet movement and electrical connection can mate with the right side interface 62 of the input/registration module 50 of FIG. 5, or with any other module with a common matching interface. The module transporter may optionally include an image quality sensor 65 for detecting the image or registration of sheets being transported through it.

Figure 7:
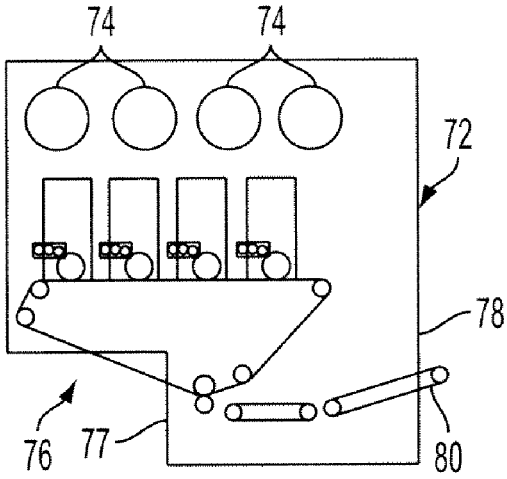
FIG. 7 is a schematic of a modular color integrated marking engine for use in a vertically stacked marking engine arrangement.

Referring to FIG. 7, a modular multicolorant integrated marking engine is illustrated as contained in its own cabinet or housing shown in solid outline and indicated generally at 72 and includes individual colorant storage units 74. The housing or cabinet has an L shaped notch indicated generally at 76 formed therein with an left side interface 77 provided in the notch which is similar to and adapted for connecting to the right side interface 58 of the module of FIG. 5. The marking engine 72 has a right side interface 78 which has a transporter belt 80 for moving sheet stock therefrom; and, the right side interface 78 of the marking engine 72 is similar to the right side interface 22 of marking engine module 18 of FIG. 2. It should be appreciated that although module 72 of FIG. 7 is shown with 4 color housings, the module may alternatively be designed with a different number of color housings, such as 2, 4, or more than 4. If the resulting color marking module is provided with a different width than the 4 color system shown in FIG. 7, a different number of transporter the modules 64 may be employed to span the new marking module.

Figure 8:
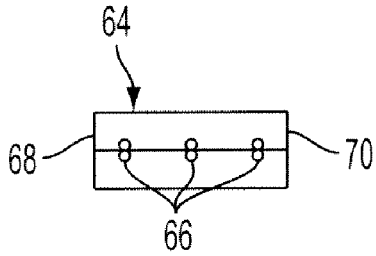
FIG. 8 is a schematic of a single transporter for sheet stock.

Referring to FIG. 8, one half of the double transporter 64 is shown with the left side interface 68, nips 66 and the right side interface 70 exposed.

Figure 9:
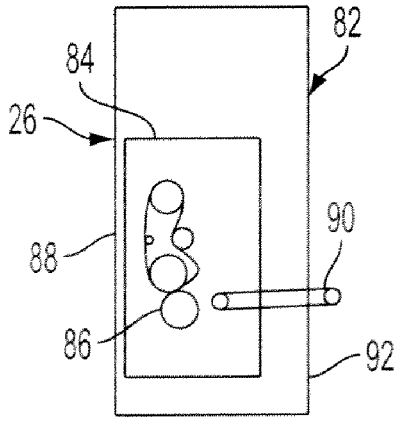
FIG. 9 is a schematic of a modular color fuser for use in an electrostatic photocopier/printer.

Referring to FIG. 9, a modular color fuser is shown in its own housing or cabinet in solid outline and indicated generally at 82 and includes a fusing element indicated generally at 84 with sheet receiving nip 86 therein and module 82 has an left side interface 88 with common connections electrically and for sheet feed with the right side interface 78 of the modular FIG. 7. The fuser module 82 of FIG. 9 includes an output transporter 90 which is similar to that of the output transporter 34 FIG. 3; and, module 82 has an right side interface 92 similar to that of the right side interface 32 of the device 26 of FIG. 3.

Figure 10:
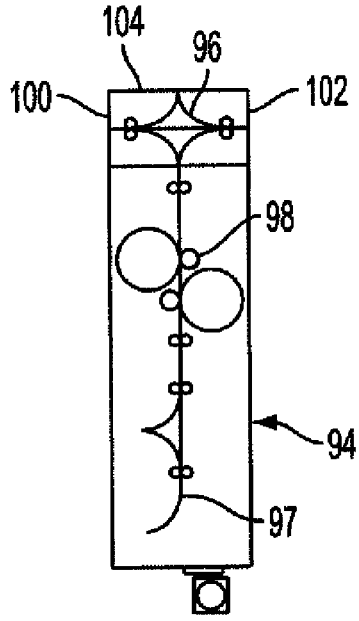
FIG. 10 is a schematic of a lower exit/inverter module for use in a system employing vertically stacked marking engines.

Referring to FIG. 10, a lower exit/inverter module is shown in solid outline in its own housing or cabinet and is indicated generally at 94. Module 94 has a transport junction 96 provided in the upper end thereof for receiving and discharging sheet stock from nip 98 provided in the module 82. The transport junction 96 has a left side interface 100 and a right side interface 102 with the left side interface 100 similar to that of the interface 70 of the device in FIGS. 6 and 8; and, it will be understood that the output face 102 may mate with the left side interface junction of an unshown modular sheet stacker feeder. The transport junction 96 also includes an upwardly facing sheet stock interface 104 which is similar to the interface 40 of the upper module 36 of FIG. 4. It should be appreciated that all upward and downward facing interfaces may be designed to mate with each other using the same type of interface used for left and right interfaces junctions. FIG. 10 also includes an inverter system 97 that enables face up output generated by the marking engine to be inverted into a face down orientation for duplexing or delivery to an output or stacking device.

Figure 11:
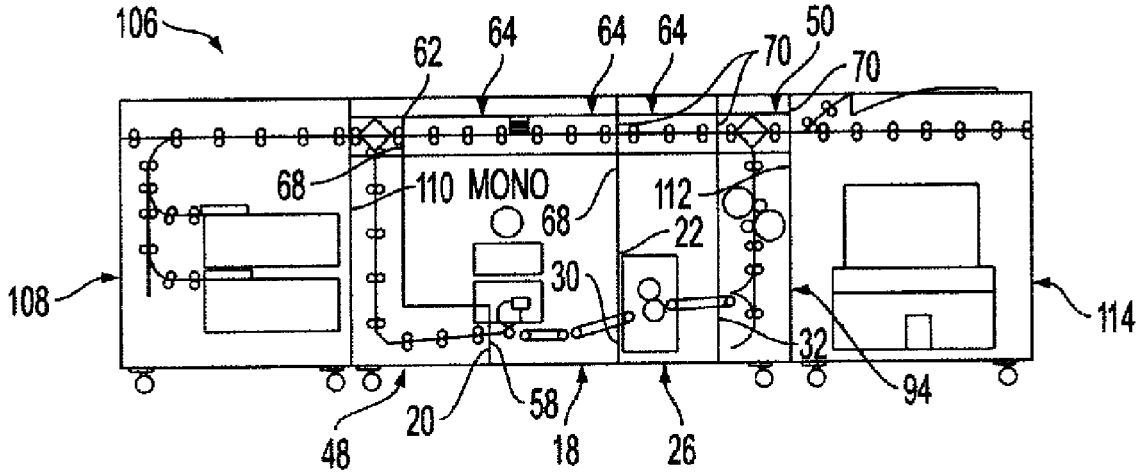
FIG. 11 is a schematic of a modular digital printing system employing a single monochromatic modular integrated marking engine.

Referring to FIG. 11, a monochromatic printing system is indicated generally at 106 and includes a modular sheet stock feeder housed in a cabinet shown in solid outline and indicated generally at 108 and which has a right side interface 110 which mates to the left side interface 60 of the module 48 of FIG. 5. The system 106 includes a module 48 of FIG. 5 which has its junction transport right side interface 62 connected to the left side interface 68 of double dual tandem transporter modules 64. The right side interface 58 of module 48 is connected to the left side interface 20 of a modular monochromatic print engine 18 which has its right side interface 22 connected to the left side interface 30 of a modular fuser 26. The fuser has mounted thereon a single transporter module 64 which has its left side interface 68 connected to the right side interface of the second of the dual transporters. The right side interface 32 of a fuser module 26 is connected to the left side interface of an exit/inverter module 94. The left side interface 112 of a modular finisher indicated generally at 114 is connected to the right side interface of module 94. The system 106 of FIG. 11 thus provides a monochromatic printing system of modular construction with each of the major components built with their own housing or cabinet and which are connected together with common interfacing for sheet path and electrical connection therebetween.

Figure 12:
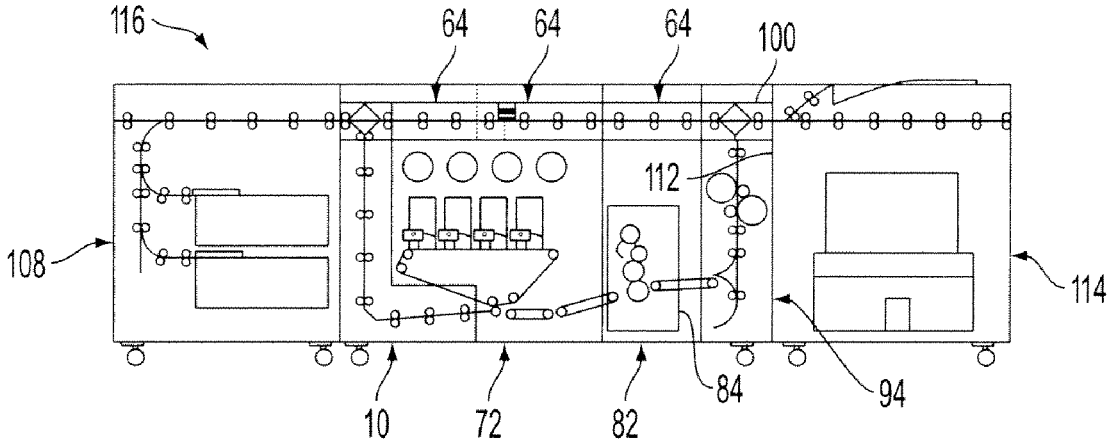
FIG. 12 is a schematic of a modular printing system employing a single modular multicolorant integrated marking engine.

Referring to FIG. 12 another printing system of modular construction is indicated generally at 116 and includes a feeder module 108 connected to a modular input/registration unit 10 which is connected to dual tandem transporter modules 64 and a multicolorant marking engine module 72 which is connected to a color fuser module 82 which has a single transporter module 64 mounted on the top thereof. The modular fuser 82 is connected to a lower inverter/exit module 94 which has its right side interface connected to the left side interface 112 of a finisher module 114. The system 116 of FIG. 12 thus provides a printing system which employs a multi-colorant integrated marking engine and fuser and which utilizes the remaining modules in common with the system 106 of FIG. 11.

Figure 13:
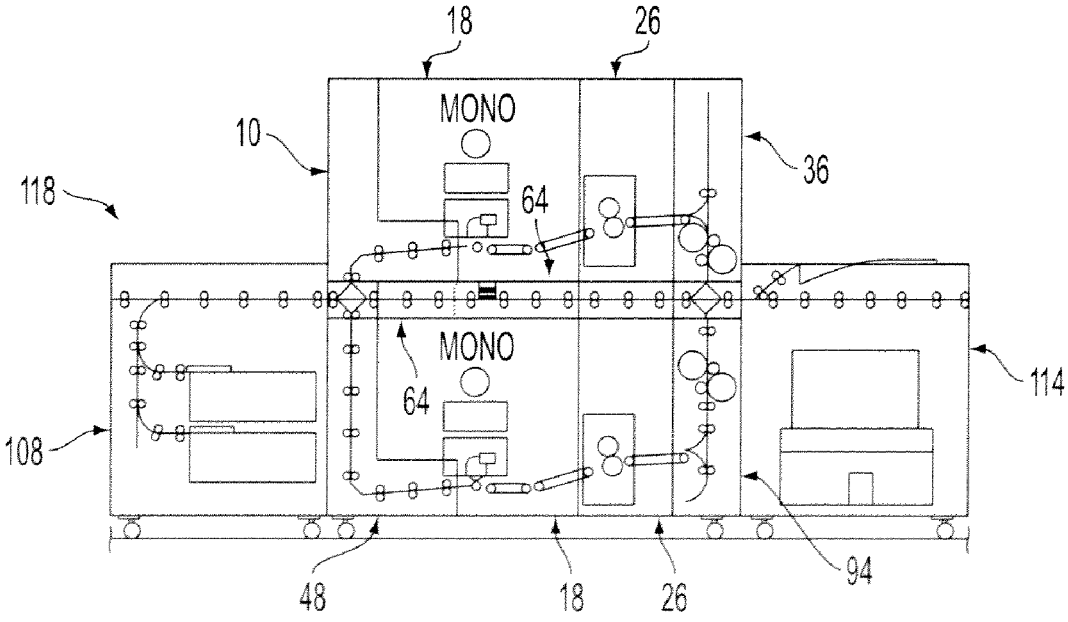
FIG. 13 is a schematic of a modular printing system implying dual vertically stacked monochromatic integrated marking engines.

Referring to FIG. 13, a version of a modular printing system is indicated generally at 118 and is formed by interconnection of a feeder module 108, a lower input/registration module 48, a monochromatic integrated marking engine 18 surmounted by dual tandem transporter modules 64 with an upper input registration module 10 connected thereto and a second or upper monochromatic integrated marking engine 18. The lower marking engine 18 is connected to a lower fuser module 26; and, the upper integrated marking engine 18 is connected to an upper fuser module 26 with the lower and upper fuser modules 26 respectively connected to a lower exit inverter module 94 and an upper exit inverter module 36. The lower exit inverter module is connected to a finisher module 114. The system of FIG. 13 thus permits simultaneous printing with parallel sheet paths through the upper and lower marking engines 18 with the completed print job assembled in a single finisher 114.

Figure 14:
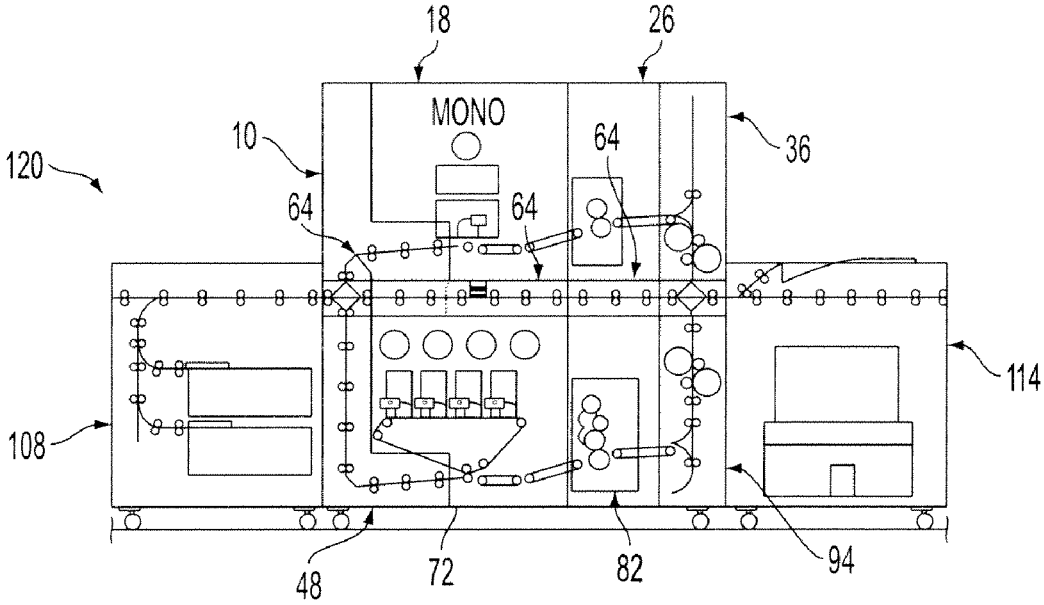
FIG. 14 is a schematic of a modular printing system employing a modular multicolorant integrated marking engine and a modular monochromatic integrated marking engine disposed in vertically stacked arrangement.

Referring to FIG. 14, another printing system is indicated generally at 120 and is formed by interconnecting the modules of FIGS. 1-10 and includes a feeder stacker module 108 connected to a lower input/registration module 48 which is connected to a lower multicolorant integrated marking engine 72 which is surmounted by dual tandem transporter modules 64 the first of which has disposed vertically stacked thereon an upper input/registration module 10 which is connected to an upper monochromatic integrated marking engine module 18. The lower marking engine module 72 is connected to a lower fuser unit 82 which is surmounted by a single transporter module 64; and, lower fuser module 82 is connected to a lower exit/inverter module 94. The upper fuser module 26 is stacked upon module 82 and module 26 is connected to an upper exit/inverter module 36. The inverter junction 96 of module 94 is connected to a finisher module 114. The system 120 of FIG. 14 is thus capable of simultaneously monochromatic and color printing with parallel paper paths feeding into a common finisher for assembling the job.

Figure 15:
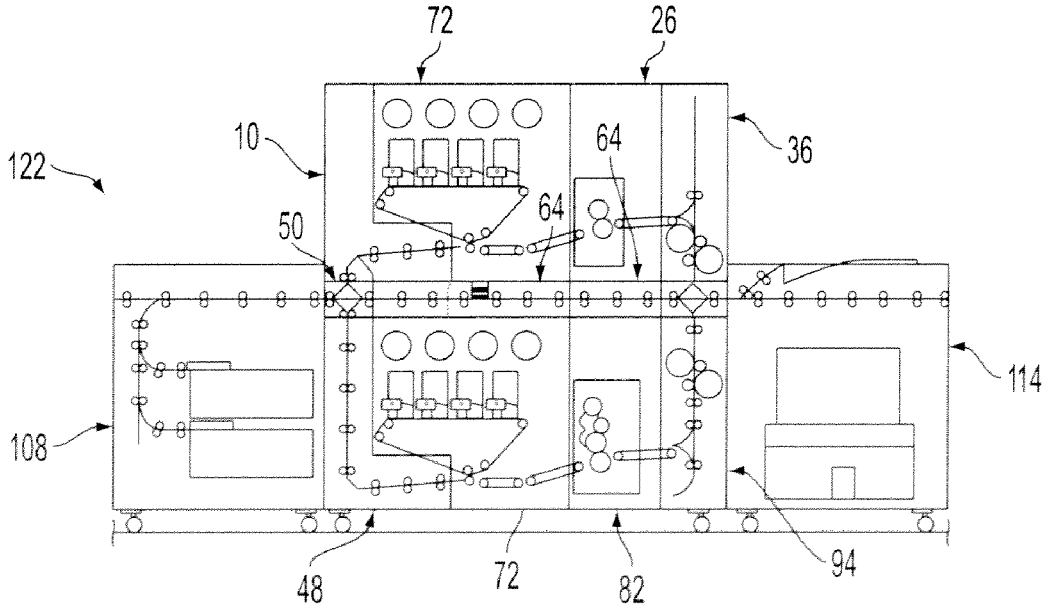
FIG. 15 is a schematic of a modular printing system employing dual digital integrated multicolorant marking engines disposed in vertically stacked arrangement.

Referring to FIG. 15, another modular printing system is indicated generally at 122 and is formed of a feeder stacker module 108 connected to a lower input/registration module 48 which includes a transport junction module 50. An integrated multicolorant marking engine module 72 is connected to the lower right side interface of module 48; and, the marking engine module 72 is surmounted by dual tandem transporter modules 64 the first of which receives sheet stock from the output of junction inverter module 50. An upper input/registration module 10 surmounts the transport junction module 50 and the first of the dual tandem transporter modules 64. The module 10 is connected to input sheet stock to an upper multicolorant integrated marking engine module 72. The lower marking engine module 72 inputs sheet stock to a lower fuser module 82 which is connected to output and feed sheet stock to a lower fuser module 82. The lower fuser module 82 is surmounted by a single exit module 94. The upper multicolorant marking engine 72 is connected to feed sheet stock to an upper fuser 26 which is connected to an output sheet stock to an upper output/registration module 36. The inverter junction 96 of exit module 94 outputs sheet stock to the single finishing module 114.

The system of FIG. 15 thus permits simultaneous parallel path printing of colorant in the upper and lower marking engines 72 and collects the printed sheet stock from both marking engines in the single finisher 114.

Figure 16:
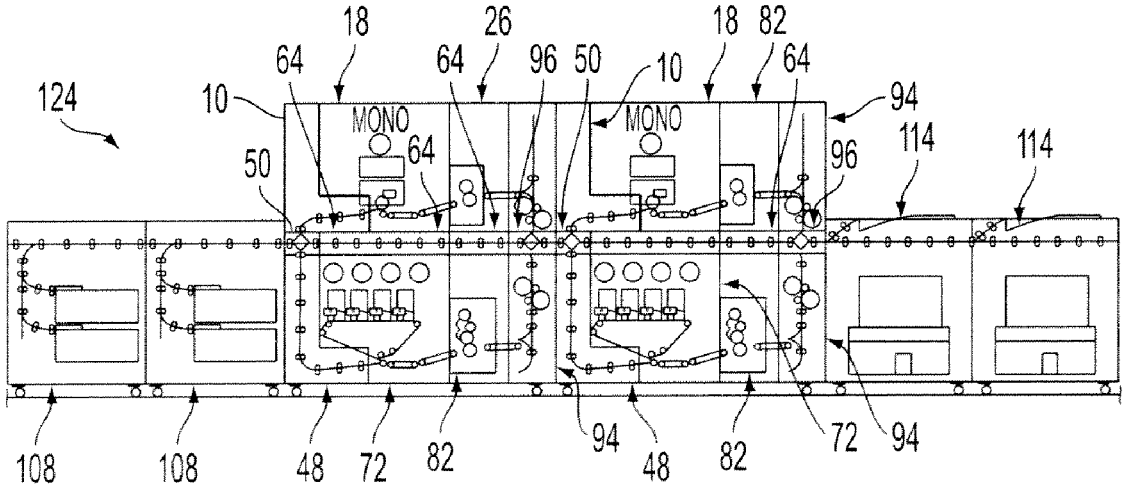
FIG. 16 is a schematic of a modular digital printing system employing a first set with a multicolorant integrated marking engine and a set of monochromatic integrated marking engine disposed in vertically stacked arrangements in tandem with a second similar set of modular integrated marking engines.

Referring to FIG. 16, another modular printing system for sheet stock is indicated generally at 124 and comprises dual modular feeder stackers 108 connected in tandem for single sheet stock flow to transport junction module 50 which is part of lower input/registration module 48 which is connected to feed sheet stock into a lower multicolorant integrated marking engine 72 which is surmounted by dual tandem transporter modules 64. An upper input/registration module 10 receives sheet stock from the transport junction module 50 and outputs the sheet stock to an upper monochromatic integrated marking engine 18 which is connected to output sheet stock to an upper fuser module 26. The lower marking engine 72 is connected to an input sheet stock to a lower fuser module 82, which is surmounted by a single transporter module 64. The lower fuser module 82 is connected to a lower exit/inverter module 94 which has an inverter junction 90 therein. The lower exit module 94 is connected to a second lower input/registration module 48 which is also surmounted by a junction transport module 50 and the module 48 input sheet stock to a second color integrated marking engine 72 which is surmounted by a single transporter module 64; and the lower arcing engine 72 is connected to a second lower fuser module 82 which outputs sheet stock to a second lower output/registration module 94 which is surmounted by another transport junction module 50. A second upper input/registration module 10 outputs sheet stock to a second upper monochromatic modular integrated marking engine 18 which outputs sheet stock to a second upper fuser module 82 which is connected to an output sheet stock to a second upper output/registration module 94. The fourth transport junction 96 of module 94 outputs sheet stock to a first finishing module 114 which is connected in tandem with a second finishing module 114. The system of FIG. 16 thus provides parallel printing capacity and tandem printing capacity of both monochromatic and colorant printing and combinations thereof including duplex printing and hybrid duplex printing consisting of combinations of monochrome and color images.

Figure 17:
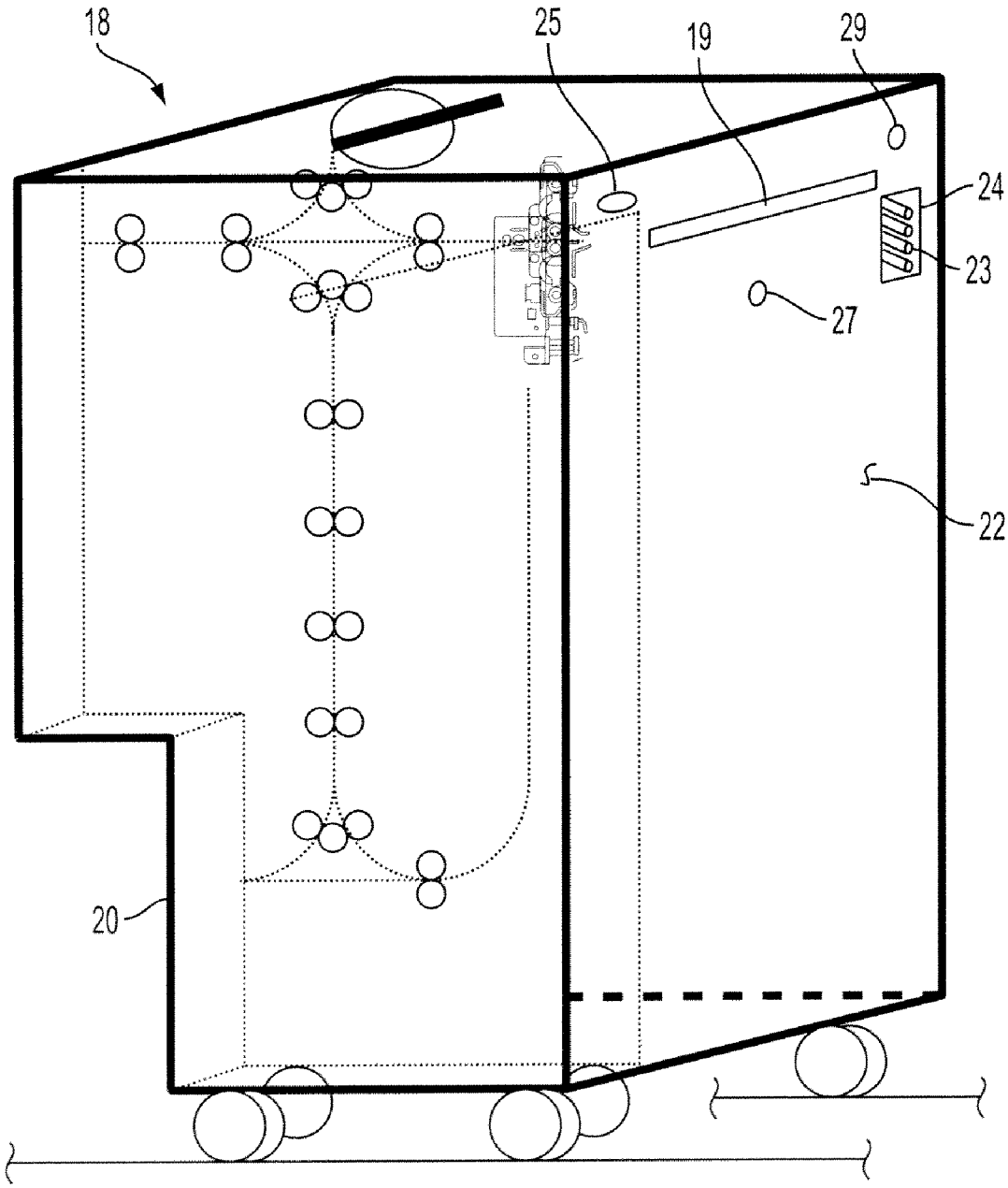
FIG. 17 is a perspective view of an output module in its own cabinet showing the sheet stock feed interface, the electrical interface connection and the locator/registration pin apertures; [COMMENT.

Referring to FIG. 17, an integrated marking engine module, such as for example, module 18, is illustrated to show the features of the right side interface 22 thereof which has a slot 19 for output of sheet stock and an electrical receptacle 21 with connector pins 23 therein for plug-in electrical connection thereto. The interface 22 also includes registration apertures for facilitating the interconnection of the interface 22 to the interface of an adjoining modular unit. Although not shown in FIG. 17, the left side interface 20 of the module 18 will contain similar sheet slots, a mating electrical element and registration pins that protrude into the holes and slots 25, 27 and 29. Thus, the interconnection for sheet stock feed and electrical connection of the modules is intended to have a common format to reduce manufacturing costs and to facilitate assembly of the modules to form a system.

Figure 18A:
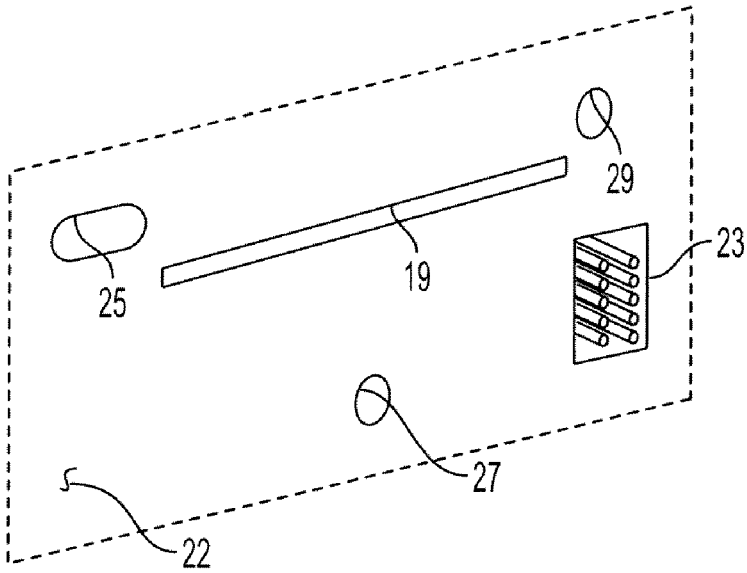
Figure 18B:
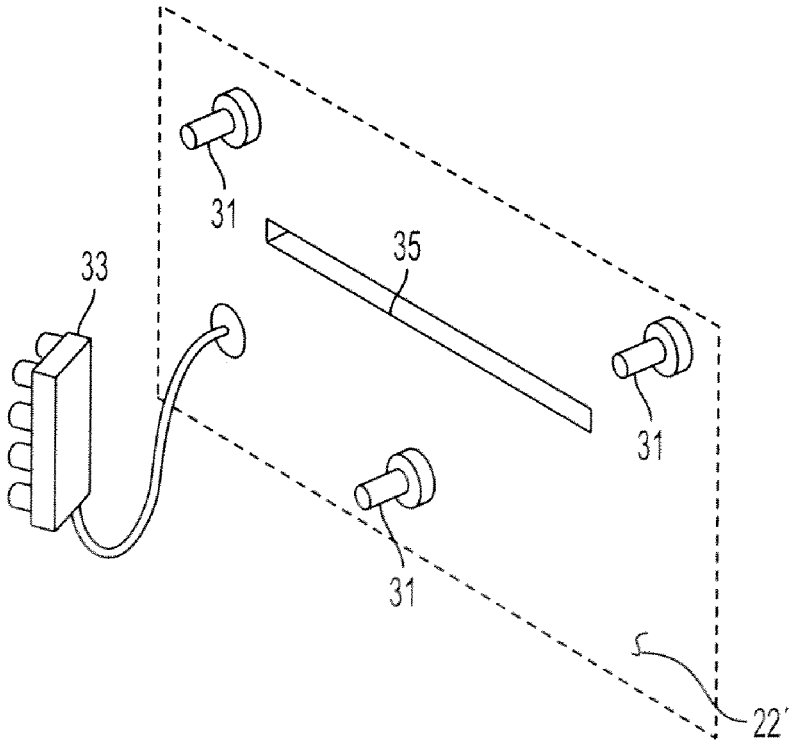
FIG. 18*b* is an enlarged view of a mating right hand portion of the interface for the module of FIG. 17.

Referring to FIG. 18*a*, a left hand portion of interface 22 is shown in enlarged view where the electrical receptacle 23 and sheet stock feeding stock 19 are shown in greater detail. Referring to FIG. 18*b*, an exemplary matching right side interface 22' is shown with alignment pins 31 hereinafter described and an electrical connector 33 configured to connect to receptacle 23. A correspondingly located slot 35 for paper transport aligns with slot 19. It should be appreciated that the interface shown is just one example of a common docking interface and is not limited to the particular configuration illustrated in the drawings.

Figure 19:
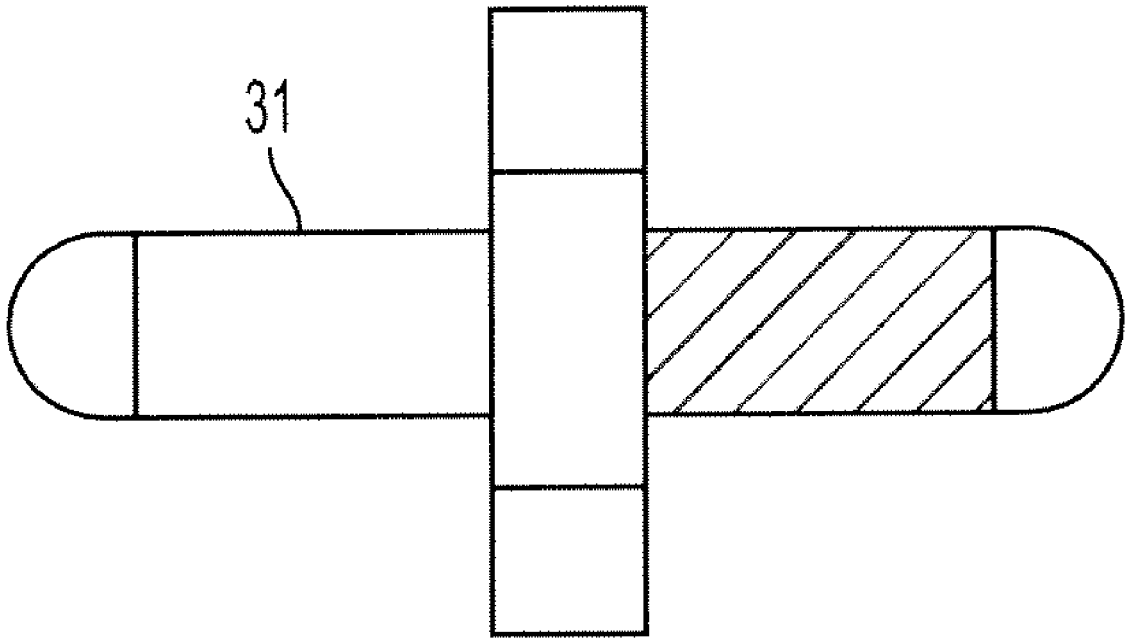
FIG. 19 is a view of a registration/interface pin employed in the module of FIG. 17.

The aperture 25 is shown as a horizontally extended slot; whereas, the lower aperture 27 is shown as an enlarged clearance hole. The upper right hand aperture 29 is sized to closely inner fit a connecting pin for locating the interface 22 with respect to similar features on an adjacent module to which the module 18 is connected and the slot 25 and clearance hole 27 adapted to also engage connecting pins. Referring to FIG. 19, a threaded stud 31 is shown which may be provided with threads for threadedly engaging the right side interface, whereas unthreaded studs or pins would slip flit into the slot 25 and the clearance hole 27 of the right side interface for ease of registration of connecting the interface modules.

Figure 20:
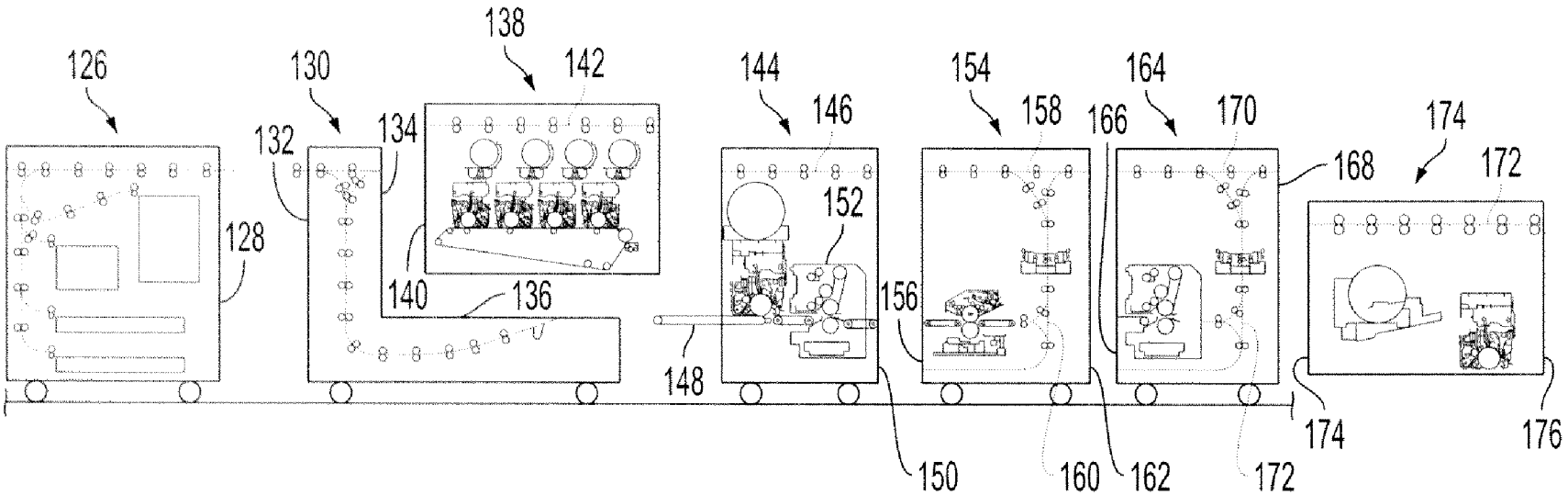
FIG. 20 is a view of a set of modular printing system elements enabling a hybrid single sheet path arrangement with a single multicolorant integrated marking engine and a single monochromatic marking engine in tandem.

Referring to FIG. 20, another set of modules each having their own internal supporting structure, such as a frame (not shown) and housing or cabinet is illustrated in solid outline and which have somewhat different configurations from the modules described and illustrated in FIGS. 1-10. A feeder stacker module employing multiple sizes of sheet stock is indicated generally at 126 and is contained with its own unshown internal support structure in a cabinet or housing shown in solid outline in FIG. 20. The module 126 has a right side interface 128 which it will be understood has sheet feeding and electrical connections and registration apertures as shown typically in FIG. 18*a* and FIG. 18*b*. The modules illustrated in FIG. 20 are intended for modular construction of a printing system employing single path sheet stock feed with "hybrid" printing capabilities.

An input/registration module is indicated generally at 130 and has a generally L shaped configuration for interconnecting with a generally rectangular shaped integrated marking engine; and, module 130 has a left side interface 132 and a transport right side interface 134 and a second horizontal sheet stock interface 136.

A multicolorant integrated marking engine module is indicated generally at 138 having a generally rectangular configuration and has a sheet stock interface for sheet stock input 140 and a multiple nip transporter 142 for transporting sheet stock therethrough.

A monochrome marking engine module with built in fuser is indicated generally at 144 and includes a pass-through transporter 146 and a sheet stock input belt 148 for receiving sheet stock from the input/registration module 130. The module 144 has a right side interface 150 for connection to an output/registration module or to other modules with an appropriate matching interface. Module 144 also includes a monochromatic fuser 152 contained within its housing or cabinet.

An integrated monochromatic printing engine and fuser module is indicated generally at 154 with its own unshown internal support structure or frame within a housing or cabinet shown in solid outline and includes an left side interface 156 for receiving sheet stock from a marking engine and module 154 has a pass through transporter 158 which includes an inverter 160 for feeding sheet stock. The module 154 includes a right side interface 162 having connection features as illustrated in FIGS. 18*a* and 18*b* for connection to an adjoining module.

A multicolorant fuser module is indicated generally at 164 and has its own supporting structure (not shown) and is housed in a housing or cabinet shown in solid outline. The fuser module 164 has a sheet stock interface 166 and a right side interface 168 for connection to adjacent modules and which may have interconnecting features as shown in FIG. 18*a* and FIG. 18*b*. The module 164 includes a transporter belt 170 and an inverter 172.

An alternate arrangement of a monochromatic integrated marking engine is indicated generally at 174 and includes a multiple nip pass-through transporter 172 and a left side interface 174, and right side interface 176 which interfaces, it will be understood, have interconnecting features as shown in FIG. 18*a* and FIG. 18*b*.

Figure 21:
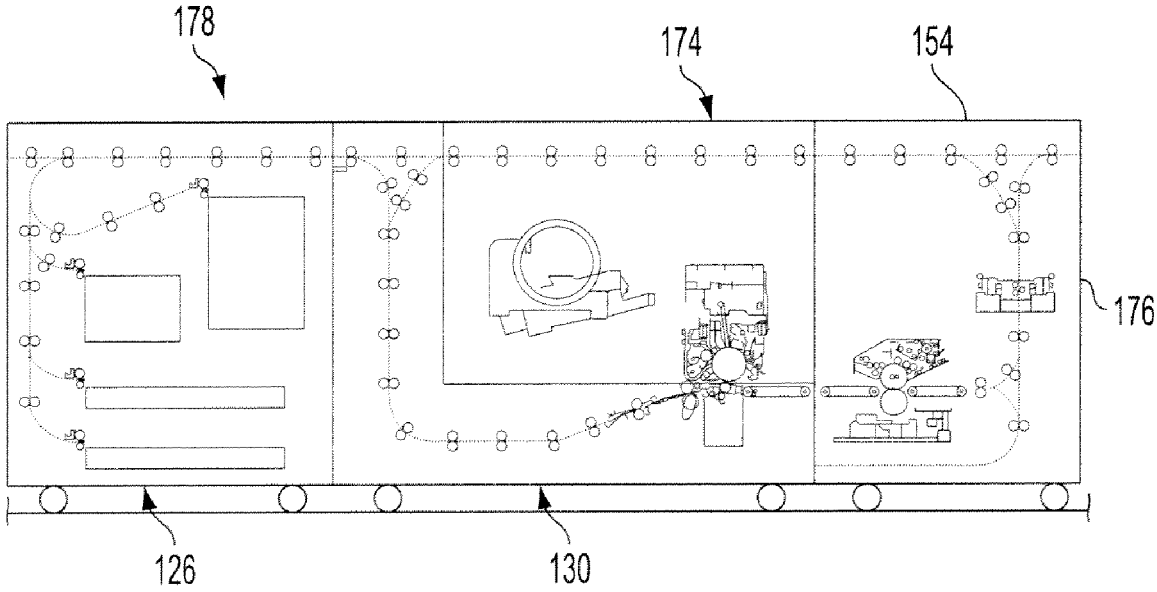
FIG. 21 is a schematic of a digital printing system using a subset of the elements shown in FIG. 20 employing modular construction with a single multicolorant integrated marking engine.

Referring to FIG. 21, a single engine printing system is indicated generally at 178 and includes a sheet feeder module 126, an input/registration module 130 connected to the feeder module 178 and a monochromatic integrated marking engine 174 connected to the input registration module 130. The marking engine module 174 is connected to a monochrome fuser and inverter/exit module 154. The system 178 of FIG. 21 provides for single path sheet stock monochromatic printing and is adapted for connection to a finishing module at the right side interface 176 of module 154.

Figure 22:
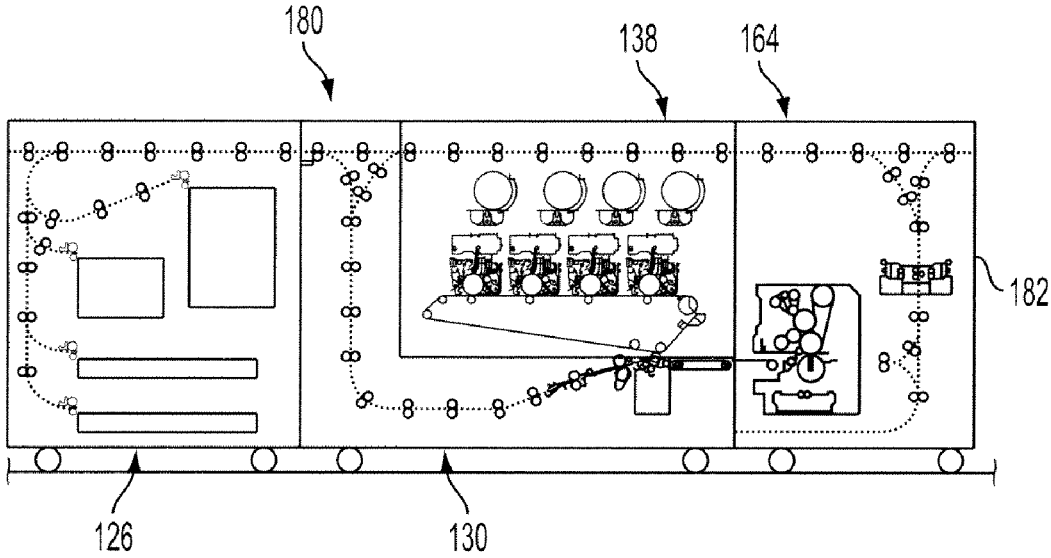
FIG. 22 is a schematic of a digital printing system using a subset of the elements shown in FIG. 20 employing modular construction with a single multicolorant integrated marking engine.

Referring to FIG. 22, another version of a modular digital printing system is indicated generally at 180 and includes a feeder module 126 and an input/registration module 130 connected thereto with a multi-colorant integrated marking engine module 138 connected to the input module 130. The marking engine module 138 outputs to a color fuser module 164 which has a right side interface 182 which is adapted for connection to a finishing unit. Each of the modules in the embodiment 180 of FIG. 2 may have the interface connections formed as shown in FIG. 18*a* and FIG. 18*b*. The system 180 of FIG. 22 thus provides a modular printing system for multi-colorant printing either duplex or simplex.

Figure 23:
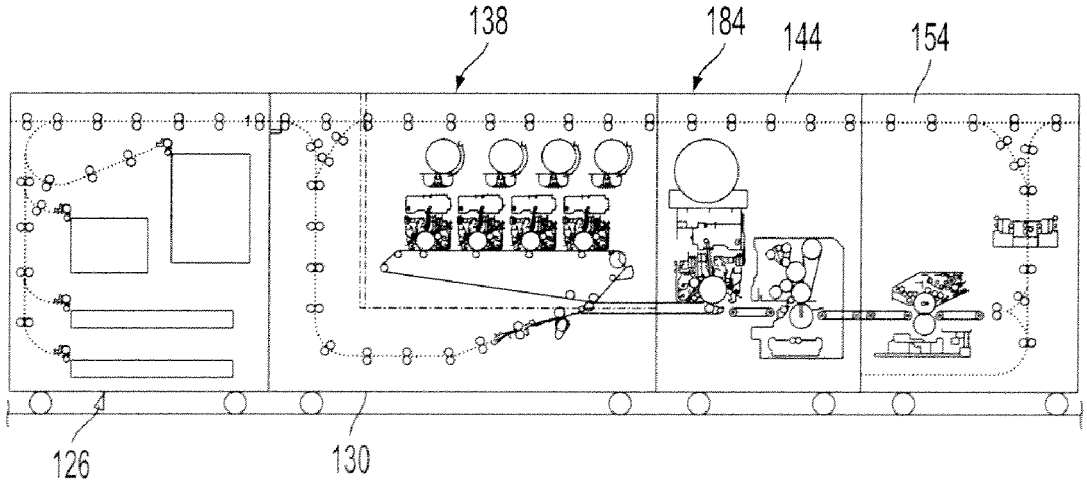
FIG. 23 is a schematic of a digital printing system using the elements shown in FIG. 20 having a multicolorant integrated marking engine with a monochromatic modular integrated marking engine in tandem such that a single media path passes through both marking engines.

Referring to FIG. 23, another version of a modular printing system is indicated generally at 184 and includes a feeder module 126 and an input/registration module 130 connected to receive sheet stock from the feeder 126. A multi-color integrated marking engine 138 is connected to the upward interface of the input/registration module 130; and, a monochromatic modular marking engine with integrated color fuser is attached to the right side interface of the color marking engine 138; and, a monochromatic fuser 154 is attached to the right side interface of the module 144.

The system 184 of FIG. 23 thus provides a single sheet stock path with the capability of color or monochromatic printing or a combination of monochromatic and color in both simplex and duplex.

Figure 24:
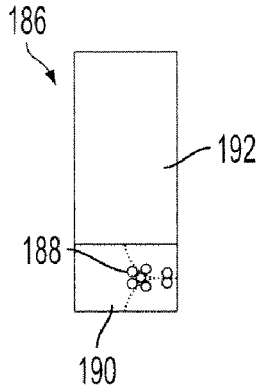
FIG. 24 is a schematic of another version of an input transport module for sheet stock.

Referring to FIG. 24, another version of an input module is indicated generally at 186 and includes an inverter 188 and a left side interface 190 and right side interface 192.

Figure 25:
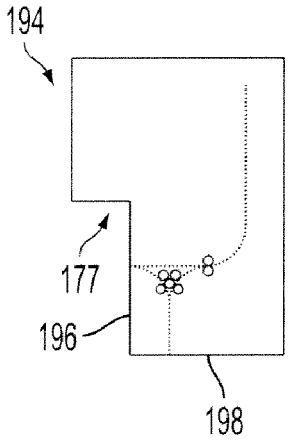
FIG. 25 is another version of an exit/inverter module for sheet stock.

Referring to FIG. 25, another version of an output module is indicated generally at 194 and includes a left side interface 196 formed in a notch denoted generally 177 and another interface on the lower surface thereof indicated by reference numeral 198. As described previously, this interface could be of a similar type to the left and right interfaces shown in FIG. 18*a* and FIG. 18*b*.

Figure 26:
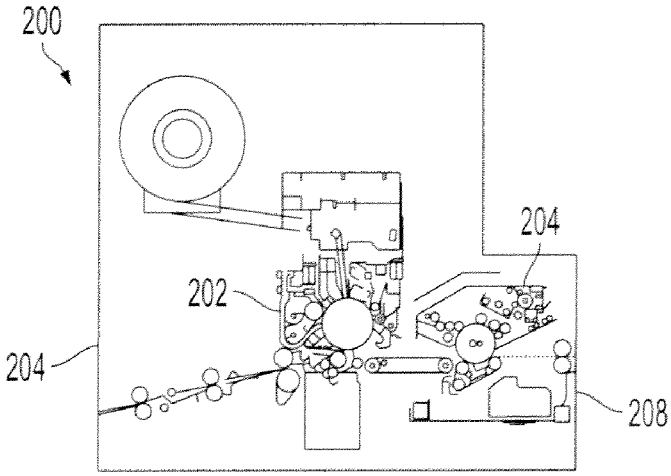
FIG. 26 is a schematic of a combination monochromatic integrated registration, marking engine and fuser module.

Referring to FIG. 26, another embodiment of a monochromatic integrated marking engine is indicated generally at 200 and includes a photoreceptor assembly 202 and a fuser 204 mounted on a common frame or support structure (not shown) and enclosed in a housing or cabinet as shown in solid outline in FIG. 26. The module 200 has a left side interface 206 and a right side interface 208 for single path movement of sheet stock therethrough.

Figure 27:
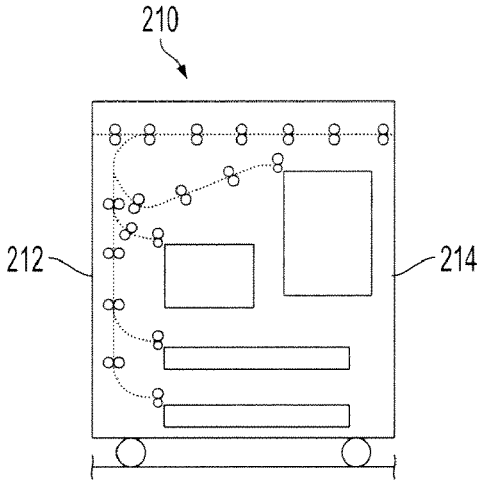
FIG. 27 is a schematic of a sheet feeder module.

Referring to FIG. 27, another embodiment of a feeder for sheet media is indicated generally at 210 and includes a left side interface 212 and a single path right side interface 214 and has its own support structure or frame (not shown) and is contained in a housing or cabinet as shown in solid outline in FIG. 27.

Figure 28:
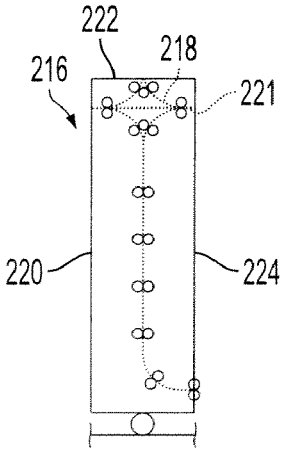
FIG. 28 is another version of an input transport module.

Referring to FIG. 28, another version of an input module is indicated generally at 216 and includes a junction transport 218 and has a left side interface 220, an upper interface 222, an upper right side interface 221 and a lower right side interface 224. The module 216 is mounted on its own support structure or frame (not shown) and enclosed in a housing or cabinet as illustrated in solid outline in FIG. 28.

Figure 29:
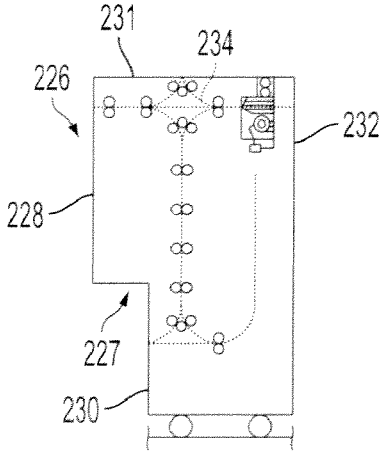
FIG. 29 is a schematic of another version of an exit/inverter module.

Referring to FIG. 29, another version of an output module is indicated generally at 226 and has an upper left side interface 228 and a lower left side interface 230 formed in a notch indicated generally at 227; a top interface 231 and, a right side interface 232 is formed on the opposite side of the module. The module is provided with a transport junction 234 and is of the type to provide bypass or transport feed of sheet media in addition to receiving marked sheets from a marking engine at the lower interface 230 or from a marking engine via the upper interface 231.

Figure 30:
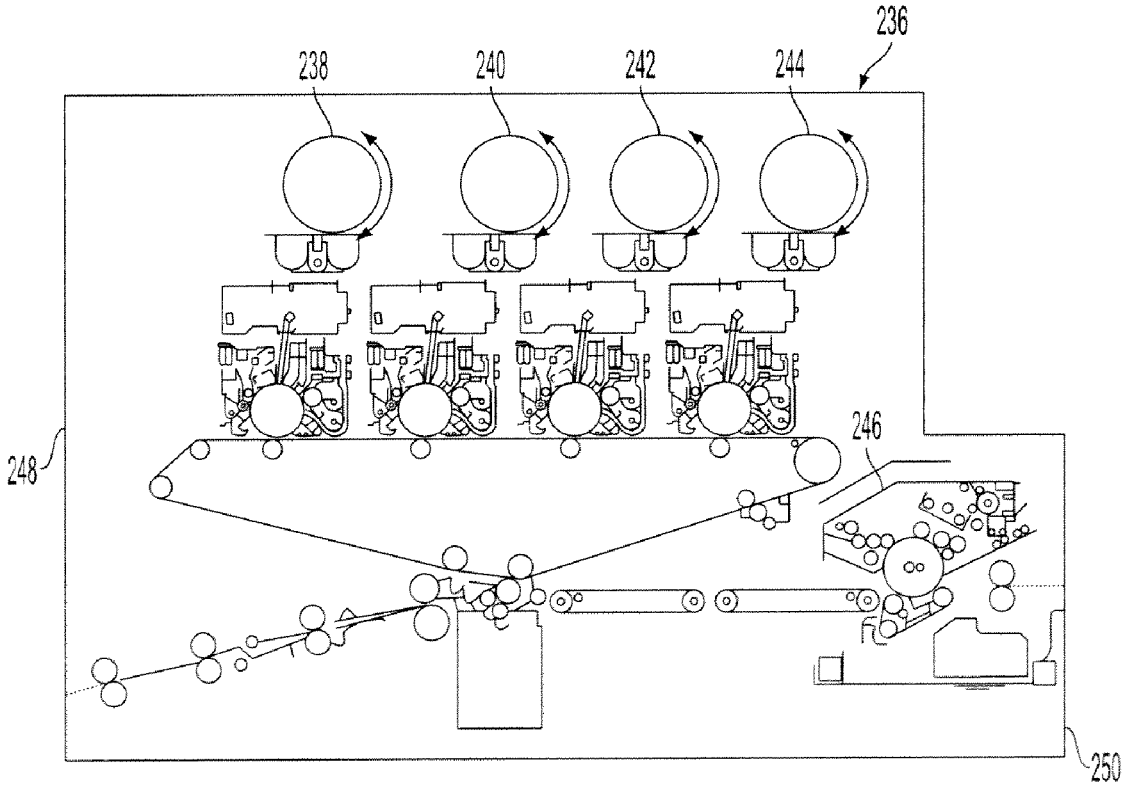
FIG. 30 is a schematic of a combination multicolorant integrated registration, marking engine and fuser module.

Referring to FIG. 30, a four color integrated marking engine module is indicated generally at 236 and has a common support frame or structure (not shown) with its own cabinet indicated in solid outline in FIG. 30. Module 236 has a plurality of colorant storage devices 238, 240, 242, 244 and its own color fuser 246 housed within the cabinet. The module 236 includes a left side interface 248 and a right side interface 250 for single path sheet traverse therethrough.

Figure 31:
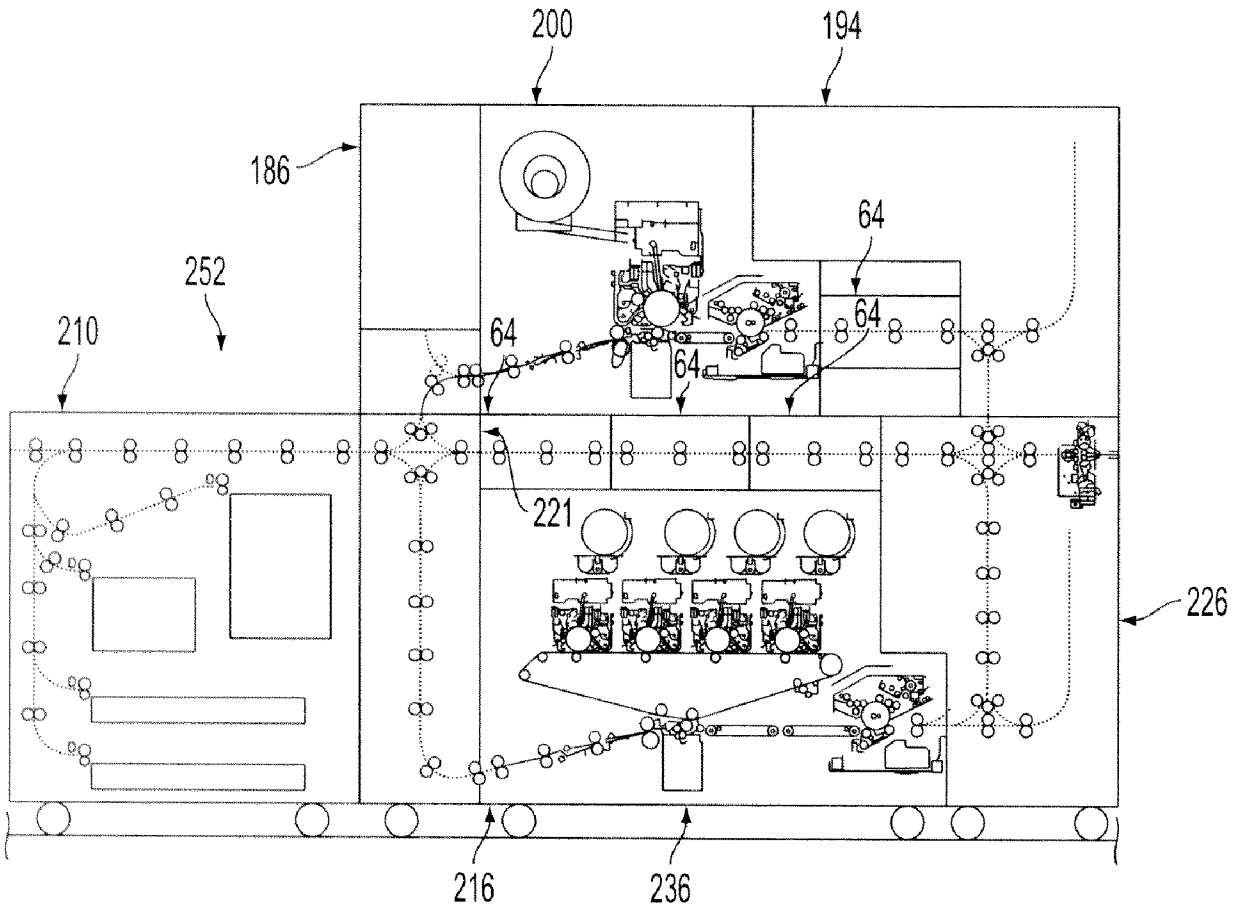
FIG. 31 is a schematic view of another version of a digital printing system employing both a modular multicolorant integrated marking engine and a monochrome marking engine stacked vertically, each with its own exit module.

Referring to FIG. 31, another version of a modular printing system is indicated generally at 252 and has a sheet feeder 210 providing sheet media to an input module 216 which is connected to the left side interface of a multi-color marking engine 236. The upper side transport output 221 of module 216 is connected to an interface of a first of triple tandem transport module 64 which is connected to a second transport module 64 which is connected to a third transport module 64, all of which are mounted on top of the marking engine 236.

The output of the colorant marking engine 236 is connected to the lower input of output module 226 which has its upper transport interface connected to the interface of third transport module 64.

A monochromatic marking module 200 is disposed above the triple tandem transport modules 64; and, the marking module 200 has its interface connected to the interface of an input module 186 which sits atop the input module 216. The output of the marking module 200 is connected to the input of a single transport module 64 which is connected to the interface of output module 194 which has its lower interface connected to the output module 226 and is disposed on top thereof. The system 252 of FIG. 31 thus provides simultaneous color and monochromatic printing outputting through single path media flow and may also provide for duplex marking with color on one side of a sheet and monochromatic marking on the opposite side.

Figure 32:
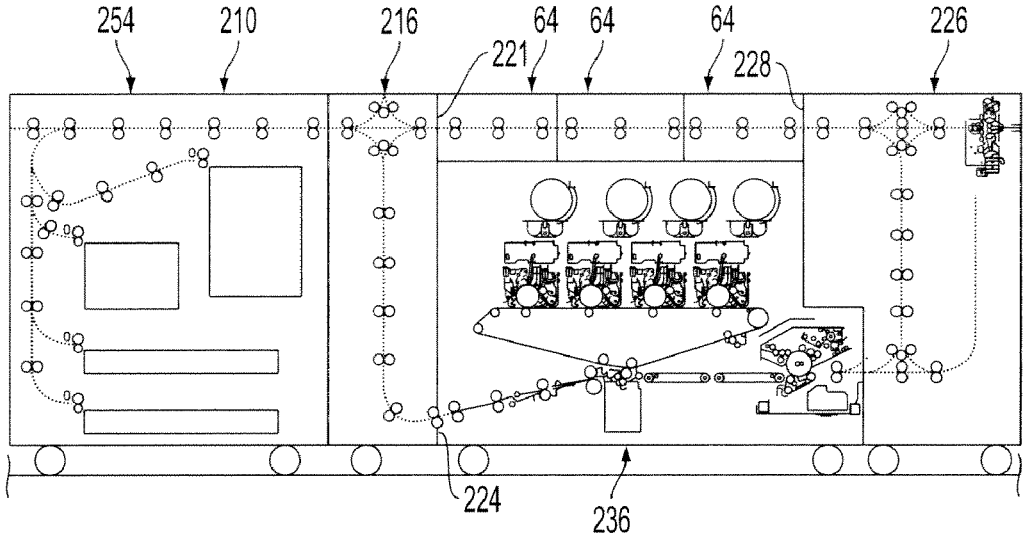
FIG. 32 is a schematic of a modular digital printing system employing a multicolorant integrated marking engine with multiple tandem transporter modules.

Referring to FIG. 32, another version of a printing system is indicated generally at 254 and has an input module 210 disposed with its right side interface connected to the left side interface of an input module 216 which has its upper right side interface or transport output 221 connected to the interface of a first of three transport modules 64 which are disposed in tandem atop a multicolorant marking engine 236. In the arrangement of the system 254, the lower right side interface 224 of the input module 216 is connected to the left side interface of the marking engine 236. The output of the third tandem transport module 64 is connected to the upper left side interface 228 of an output module 226 which has its lower left side interface connected to the right side interface of the marking engine 236. The system 254 of FIG. 32 thus provides single path media flow through a multicolorant marking engine with the capability of transporting media therethrough and bypassing the marking engine.

Figure 33:
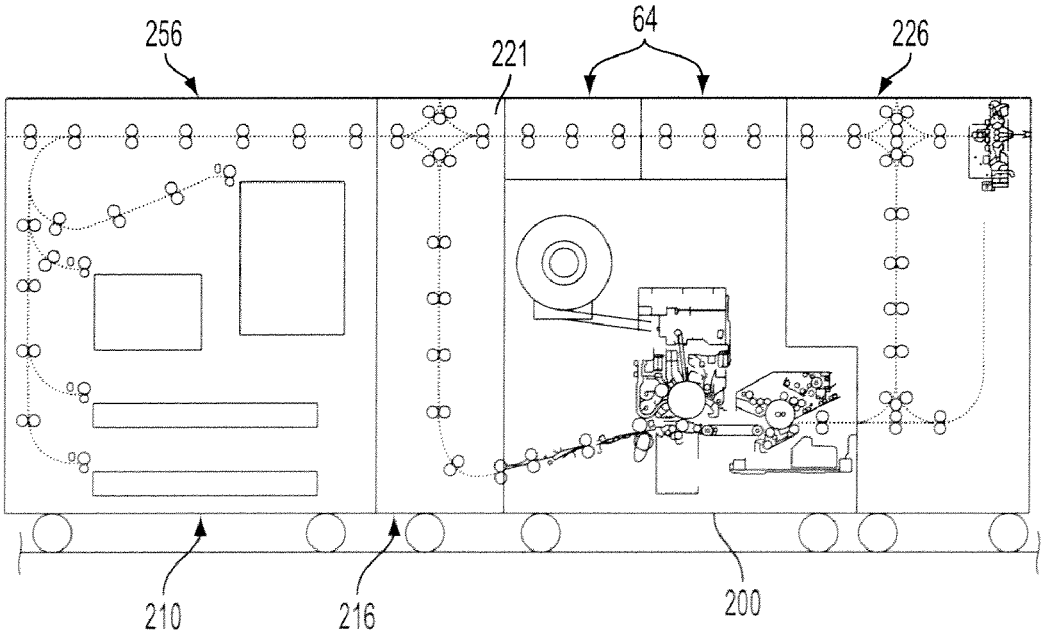
FIG. 33 is a schematic of another version of a digital printing system employing a monochromatic integrated marking engine.

Referring to FIG. 33, another version of a modular printing system is indicated generally at 256 and has a feeder module 210 with its right side interface connected to the left side interface of an input module 216 which has its upper transport side right side interface 221 connected to the left side interface of the first of dual tandem transport modules 64. The lower right side interface of the input module 216 is connected to the left side interface of a monochromatic marking engine 200 which has the transport modules 64 mounted on the upper surface thereof. The output of the second of the dual transport modules 64 is connected to the upper left side interface of an output module 226 which has its lower left side interface connected to the right side interface of the marking engine 200. The system of FIG. 33 thus is capable of single or duplex monochromatic marking on media sheet stock and a single path flow through the marking engine and includes the capability of transporting sheet stock directly therethrough and bypassing the marking engine.

Figure 34:
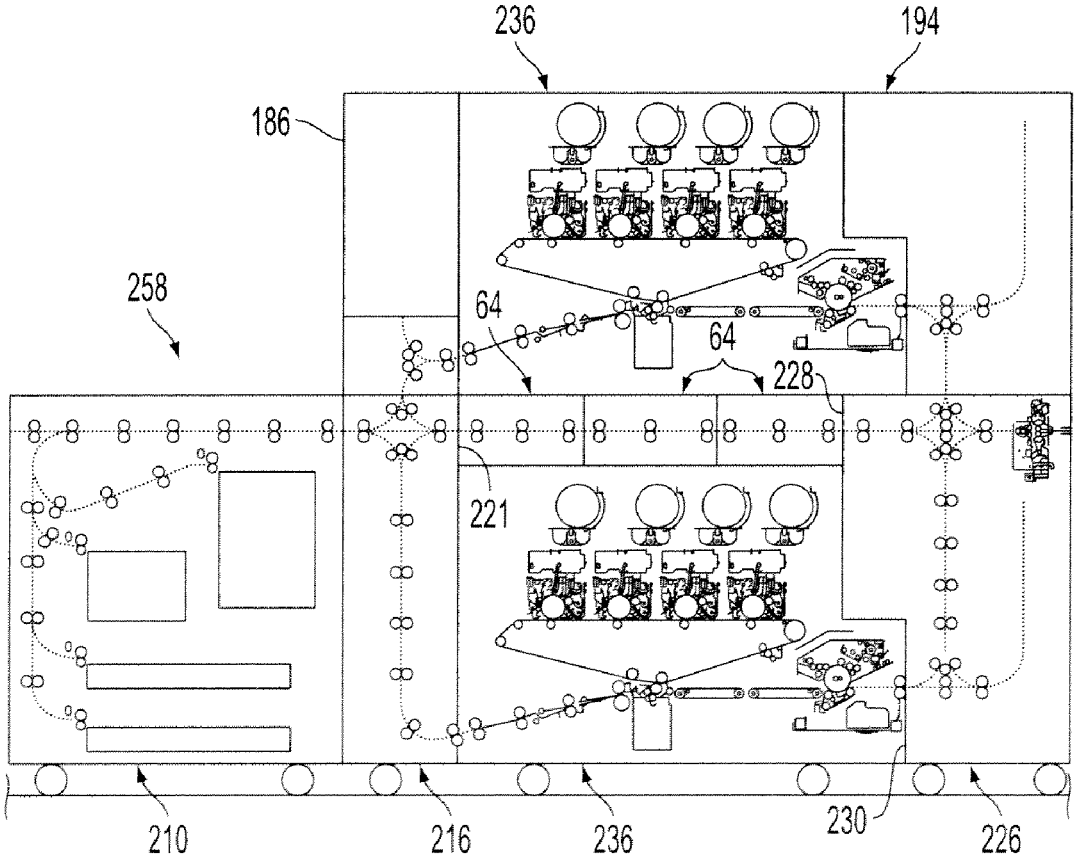
FIG. 34 is a schematic of a modular digital printing system employing dual multicolorant integrated marking engines arranged in vertically stacked arrangement.

Referring to FIG. 34, another version of a modular printing system is indicated generally at 258 and includes a feeder module 210 with its right side interface connected to the left side interface of an input module 216 which has its lower right side interface connected to the left side interface of a multicolorant marking engine 236. Triple tandem transport modules 64 are disposed vertically stacked on the marking module 236. The first of the tandem transport modules 64 has its left side interface connected to the upper side interface 221 of input module 216. The multi-color marking module 236 has its output connected to the lower input of an output module 226; and, the upper left side interface of the output module 226 is connected to the right side interface 228 of the third transport module 64.

In the system 258 of FIG. 34, the input module 216 has vertically stacked thereon another input module 186 which has its input connected to the upper side interface 222 of junction transport 218 of module 216 and its output connected to the input of a second multicolorant marking module 236 which is vertically stacked on the lower marking module 236. The output of the second multicolorant marking module 236 is connected to the left side interface 230 of an output module 194. The modular printing system 258 of FIG. 34 thus provides a capability of parallel marking in dual multicolorant marking modules with single path media sheet stock flow therethrough at the exit path.

Figure 35:
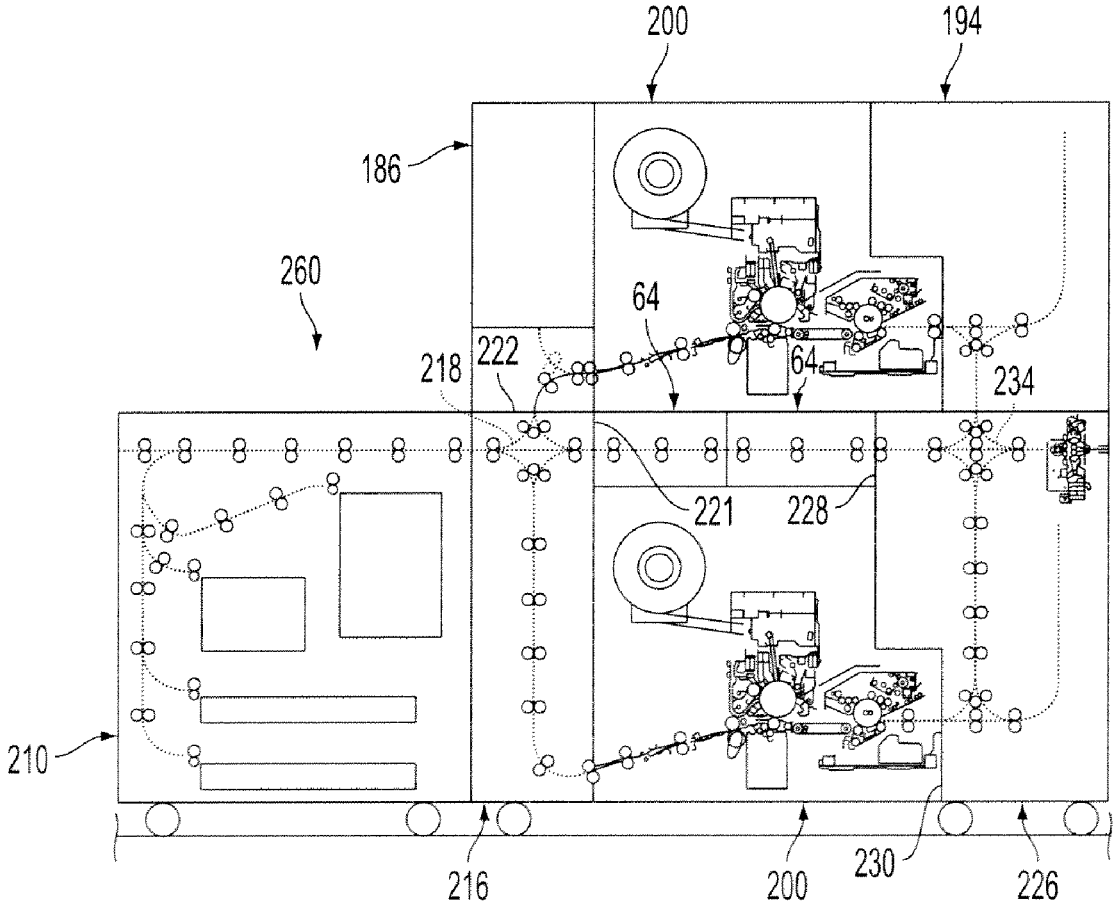
FIG. 35 is a schematic of a modular digital printing system employing dual monochrome marking engines arranged in a vertically stacked arrangement.

Referring to FIG. 35, another version of a modular printing system is indicated generally at 260 and includes a feeder module 210 with its output connected to the left side interface of an input module 216 which has its upper transport side 221 output connected to the input of the first of dual transport modules 64 disposed in tandem vertically stacked upon a monochromatic marking module 200. The output of the second transport module 64 is connected to the upper left side interface 228 of an output module 226 which has its lower left side interface 230 connected to the output of the marking module 200. A second input module 186 is vertically stacked on the lower input module 216; and, the upper input module 186 has its input connected to the right side interface 222 of transport junction 218 of module 216 with its right side interface connected to the left side interface of a second monochromatic marking module 200 which is vertically stacked upon the dual transport modules 64.

The output of the upper marking module 200 is connected to the input of a second output module 194 disposed in vertically stacked arrangement upon the lower output module 226. The upper output module 194 has its interface connected to the top side interface of transport junction 234 of the lower output module 226. The system 260 of FIG. 35 thus provides for simultaneous dual printing on two monochromatic marking engines with single path sheet flow therethrough at the exit. The system of FIG. 35 is capable of single or duplex printing in either marking module 200 independently of the marking activity in the other marking module. In addition, sheet stock may be transported through the system of FIG. 35 without marking.

The present disclosure thus describes a variety of digital printing systems with single or plural marking engine modules for providing combinations of marking capability and speeds dependent upon whether single or duplex marking is desired or whether hybrid marking of color on one side of the sheet and monochromatic printing on the opposite side is desired. The modules described and disclosed herein are each provided with their own support structure and cabinetry and have a common sheet input/output and electrical connection arrangement on the input and right side interfaces of the module cabinets. The modular construction of the systems of the present disclosure thus enable multiple functional combinations for various desired printing arrangements so as to provide such systems at a substantially reduced cost from that of built up printing equipment.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A modular digital printer for sheet media comprising at least one sheet feeding module, at least one marking module and at least one stacking/finishing module wherein said at least one marking module is comprised of:

(a) at least one marking engine module having a discrete support structure with a releasable left and right side interface for media feed/transport and electrical connection thereto;

(b) a releasable input module including a media registration system having a discrete support structure with a releasable left and right side interfaces for media feed/transport and electrical connection thereto;

(c) a releasable output module including an inverter having a discrete support structure with left and right side interfaces for media feed/transport and electrical connection thereto; and, (d) a fuser module having a discrete support structure having a releasable left and right side interface for media feed/transport and electrical connection thereto, wherein the fuser module is operative to receive media sheets at one of the left and right side interface thereof from the marking engine module.

2. The modular printer defined in claim 1, wherein the releasable input module includes an inverter.

3. The modular printer defined in claim 1, wherein the releasable input module includes an intersection transporter.

4. The modular printer defined in claim 1, wherein the at least one marking engine module includes at least one releasable transport module having at least two transport nips with a discrete support structure and a left and right side interface for media feed/transport and electrical connection thereto.

5. The modular printer defined in claim 4, wherein the releasable transport module includes an image quality sensor.

6. The modular printer defined in claim 1, wherein the releasable output module includes a sheet decurler.

7. The modular printer defined in claim 1, wherein the at least one marking engine module includes a multicolor marking engine.

8. The modular printer defined in claim 1, wherein the at least one marking engine module includes a monochrome marking engine.

9. The modular printer defined in claim 1, wherein the at least one marking engine module includes a first and second releasable marking engine module vertically stacked, each having a left and right side interface for media feed/transport and electrical connection thereto.

10. The modular printer defined in claim 1, wherein the at least one marking engine module includes a first and second releasable marking engine module positioned adjacent to one another, each having a left and right side interface for media feed/transport and electrical connection thereto.

11. The modular printer defined in claim 7, wherein the at least one marking engine module includes a plurality of modular xerographic marking elements and a sheet media belt transfer system that spans said modular xerographic marking elements.

12. The printer defined in claim 1, wherein the at least one marking engine module includes a plurality of marking engines in tandem for image-over-image marking.

13. The modular printer defined in claim 1, wherein the left and right side interfaces have a common set of docking features.

14. The modular printer defined in claim 13, wherein common docking features include a common set of docking features for mechanical connection and a common set of features for electrical connection.

15. A modular digital printer for sheet media comprising at least one sheet feeding module, an upper marking system, a lower marking system and at least one stacking/finishing module wherein said upper and lower marking systems are comprised of:

(a) an upper marking engine module having a discrete support structure with a releasable left and right side interface for media feed/transport and electrical connection thereto;

(b) a lower marking engine module having a discrete support structure with a releasable left and right side interface for media feed/transport and electrical connection thereto;

(c) upper and lower releasable input modules each including a registration system and each having a discrete support structure with a releasable left and right side interface for media feed/transport and electrical connection thereto; and (d) upper and lower releasable output modules each including an inverter having a discrete support structure with an left and right side interface for media feed/transport and electrical connection thereto; and, (e) a fuser module having a discrete support structure with a releasable left and right side interface for media transport and electrical connection thereto.

16. The modular printing system of claim 15 in which both upper and lower marking engine modules are multi-color marking engines.

17. The modular printing system of claim 15 in which one of the upper and lower marking engine modules is a multicolor marking engine and the other of the upper and lower marking engine modules is a monochrome marking engine.

18. A modular digital printer for sheet media comprising at least one sheet feeding module, at least one marking module and at least one stacking/finishing module wherein said at least one marking module is comprised of:

(a) at least one marking engine module having a discrete support structure with releasable interfaces for media feed/transport and electrical connection thereto;

(b) a releasable input module having a discrete support structure with a releasable interfaces for media feed/transport and electrical connection thereto;

(c) a releasable output module including an inverter having a discrete support structure with releasable interfaces for media feed/transport and electrical connection thereto; and, (d) a fuser module having a discrete support structure with a releasable left and right side interface for media feed/transport and electrical connection thereto.

19. A modular digital printer for sheet media comprising at least one sheet feeding module, an upper marking system, a lower marking system and at least one stacking/finishing module wherein said upper and lower marking systems are comprised of:

(a) an upper marking engine module having a discrete support structure with a releasable interfaces for media feed/transport and electrical connection thereto;

(b) a lower marking engine module having a discrete support structure with a releasable interfaces for media feed/transport and electrical connection thereto;

(c) upper and lower releasable input modules each having a discrete support structure with releasable interfaces for media feed/transport and electrical connection thereto;

(d) upper and lower releasable output modules each including an inverter having a discrete support structure with releasable interfaces for media feed/transport and electrical connection thereto; and, (e) a fuser module having a discrete support structure with a releasable left and right side interface for media feed/transport and electrical connection thereto.

20. The modular printer of claim 1, wherein one of the left and right side interface of the fuser is connected to one of the left and right side interface of the left and right side interface of the marking engine module.

* * * * *